US006250217B1

(12) United States Patent
Korybutiak

(10) Patent No.: US 6,250,217 B1
(45) Date of Patent: Jun. 26, 2001

(54) DIAPHRAGM PRESSES

(75) Inventor: Bogdan Eugene Korybutiak, Ardeer (AU)

(73) Assignee: Kory Dubay Manufacturing Australia Pty. Ltd., Sunshine North (AU)

( * ) Notice: Subject to any disclaimer, the term of this patent is extended or adjusted under 35 U.S.C. 154(b) by 0 days.

(21) Appl. No.: 09/297,195

(22) PCT Filed: Feb. 20, 1998

(86) PCT No.: PCT/AU98/00111

§ 371 Date: Apr. 27, 1999

§ 102(e) Date: Apr. 27, 1999

(87) PCT Pub. No.: WO98/38033

PCT Pub. Date: Sep. 3, 1998

(30) Foreign Application Priority Data

Feb. 25, 1997 (AU) ..... PO5313

(51) Int. Cl.[7] ..... B30B 15/34; B30B 5/02

(52) U.S. Cl. ..... 100/326; 100/211; 100/244; 100/269.04; 156/382; 156/583.3

(58) Field of Search ..... 100/90, 211, 244, 100/264, 269.02, 269.04, 325, 326; 156/382, 583.3

(56) References Cited

U.S. PATENT DOCUMENTS

| | | | | |
|---|---|---|---|---|
| 3,284,858 | * | 11/1966 | Taccone | 100/211 |
| 3,410,202 | | 11/1968 | Chrubasik . | |
| 3,850,559 | * | 11/1974 | Mintz et al. | 100/211 |
| 4,450,034 | * | 5/1984 | Stern | 100/211 |
| 4,529,472 | * | 7/1985 | Hsu | 156/583.3 |
| 5,261,997 | * | 11/1993 | Inselmann | 156/583.3 |
| 5,635,014 | * | 6/1997 | Taylor | 156/583.3 |

FOREIGN PATENT DOCUMENTS

| | | | | |
|---|---|---|---|---|
| 1 007 047 | | 4/1957 | (DE) . | |
| 3008485 | | 9/1981 | (DE) . | |
| 30 11 171 | | 10/1981 | (DE) . | |
| 30 17 258 | | 11/1981 | (DE) . | |
| 35 32 710 | | 3/1987 | (DE) . | |
| 3702-679 | | 8/1988 | (DE) . | |
| 3935562 | * | 5/1991 | (DE) | 100/211 |
| 4310302 | | 10/1994 | (DE) . | |
| 0 749 824 | | 12/1996 | (EP) . | |
| 233212 | * | 12/1968 | (SU) | 100/211 |

* cited by examiner

*Primary Examiner*—Stephen F. Gerrity
(74) *Attorney, Agent, or Firm*—Alston & Bird LLP

(57) ABSTRACT

The invention provides a multi-funtion diaphragm press having upper and lower platen assemblies separated by a flexible membrane. One of the platen assemblies is movable between a first position whereby it does not contact the flexible membrane and a second position whereby the flexible membrane is contacted to provide a rigid membrane.

15 Claims, 2 Drawing Sheets

10
12
14
16
18
18
20
20
22
24
26
28
30
32
34
36
38
40
42
44
46

DIAPHRAGM PRESSES

FIELD OF THE INVENTION

This invention relates to diaphragm presses for thermolaminating and in particular to improvements in thermolaminating presses including membrane form presses.

BACKGROUND OF THE INVENTION

Existing press technologies essentially are divided into two types—(1) day light presses, where pressing is done between two rigid plates; and (2) diaphragm presses, also known as membrane or membraneless presses, where an object or workpiece is pressed between a flexible surface and a rigid plate or between two flexible surfaces. In membrane presses the membrane seals a pressurizable chamber. When the chamber is pressurised the membrane conforms to the shape of the workpiece. Additionally vacuum may be applied to the other side of the workpiece via a vented lower platen.

As the size of the object or workpiece increases it becomes more difficult to maintain quality. This is reflected by the increasing rate of rejects caused by unrepairable creases or wrinkles in the surface finish applied by the diaphragm press. The increase in rejection rate is a significant economic cost. Instances where the risk of creasing or wrinkling is high include medium to large workpieces (eg 1200 mm–2400 mm or longer), irregular or perforated components (eg frames), thermofoils which are unstable when exposed to heat due to type, gauge, or the release of captive process stresses, hygroscopic materials which become unstable when in contact with a wet, water-based glue line (which causes undulations) (eg veneers or paper), and free standing components which must be straight after process curing temperatures and heat resistance have been achieved (eg 2400 mm high pantry doors or panels).

Present day diaphragm presses do not offer a membrane that can be either flexible or rigid. We have discovered that it is possible to provide a membrane that can be flexible or rigid as required. We have achieved this by installing, on the side of the membrane remote from the workpiece, a platen assembly which can be moved independently of and relative to the combination frame (also known as an "L" frame) and/or other frames, trays, tables, or conveyors of the press and which can bring the membrane into contact with the workpiece. Such a platen assembly may include a vented heating plate allowing the application of heat and pressure to the workpiece via the membrane as required. Parts of the surfaces of the platen assembly of the invention and the combination frame make positive contact when the platen assembly is retracted and are held or locked together to establish a seal. This results in re-establishment of the chamber of the press, and the press then functions as a normal diaphragm press in which heat, pressure and vacuum can be applied in accordance with current technology.

Thus, according to one aspect of the present invention there is provided a multi-function diaphragm press including upper and lower platen assemblies separated by a flexible membrane, one of said platen assemblies being movable between a first position whereby said one of said platen assemblies does not contact said flexible membrane and a second position whereby said flexible membrane is in contact with said one of said platen assemblies to provide a rigid membrane. Preferably said one of said platen assemblies is moved by hydraulic means.

Preferably said one of said platen assemblies can be installed in either the top or the bottom half of the press.

Alternatively, two independently movable platen assemblies can be installed in the press, one in either half. It is also possible that more than one independently movable platen assembly may be installed in either half of the press.

Preferably each platen assembly includes a plate, hereinafter called a bolster, a heating means and a vented heat exchanging means. Preferably the plate is made of steel.

Where an independently movable platen assembly is installed in the top half of a diaphragm press it provides a rigid surface adjustable by raising or lowering the platen assembly in the top half of the normally flexible press without the need to remove or add parts to the press. Retraction, sealing and/or locking of the independently movable platen assembly against the combination frame lip permits normal diaphragm press operation.

A significant advantage is that a workpiece can be flat surface-pressed with the rigid surface provided by the lowered independently movable platen assembly and, if required, flexibly 3-D pressed immediately afterward. This is particularly useful for pressing large or unusual objects or where the surface coating materials vary in type, gauge, thermal stability or memory effects or where instability affects flatness such as where a hygroscopic material like veneer contacts a wet glue line. A significant reduction in losses due to creasing of surface coatings during the pressing process can be achieved by rigid membrane flat pressing of surface coating to flat surfaces of the object or workpiece prior to a rapid changeover to flexible 3-D pressing to complete the forming and bonding of the surface coating to the surfaces of the object or workpiece.

BRIEF DESCRIPTION OF THE DRAWINGS

In order that the invention may be more clearly understood reference is now made to schematic illustrations of one embodiment of the invention in which.

DETAILED DESCRIPTION OF ONE EMBODIMENT

Figure 1:
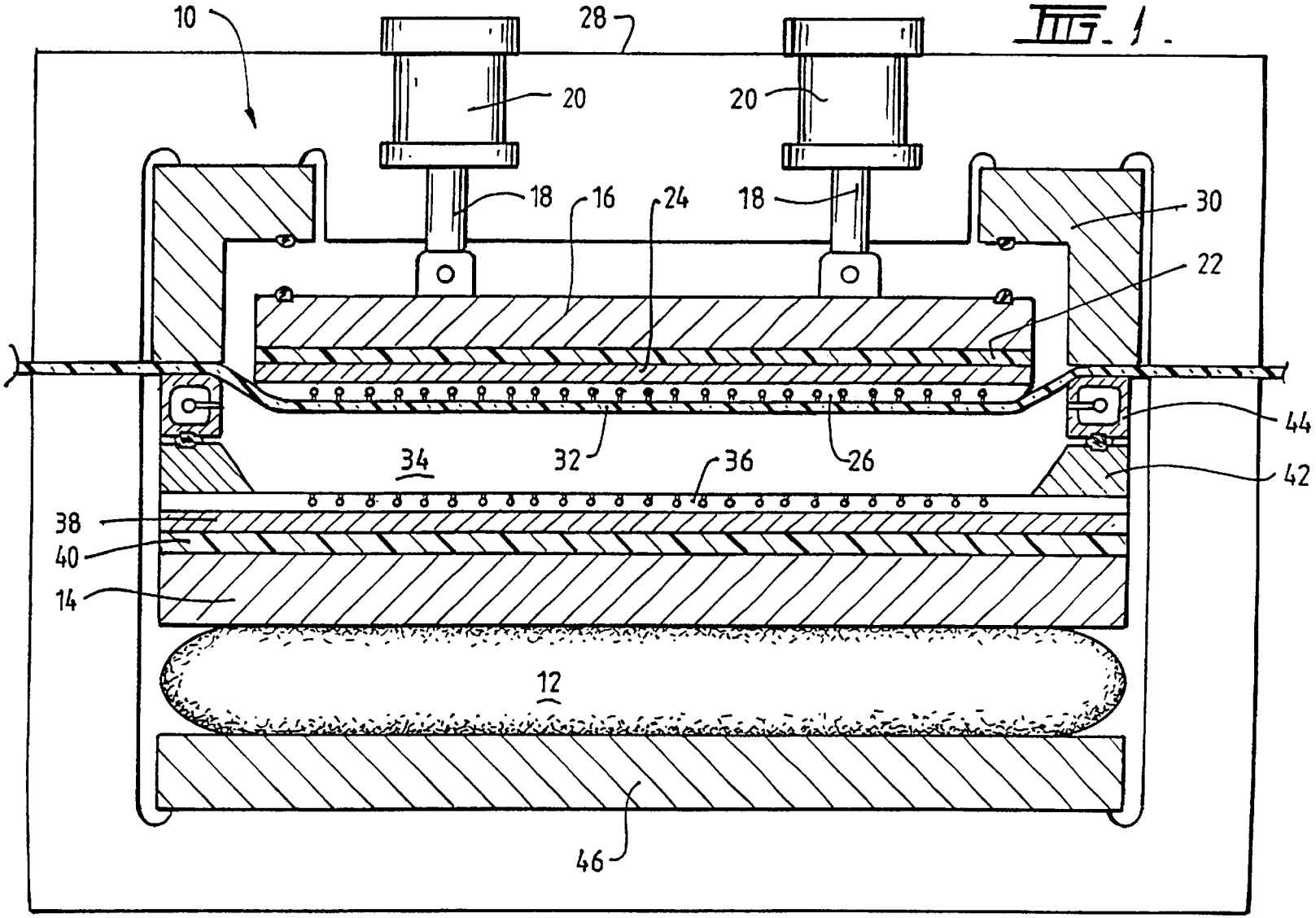
FIG. 1 depicts a section through a press with an independently movable platen assembly in a lowered position.

In the drawings the numeral 10 designates generally a diaphragm press. Press 10 utilises a pressure bag or bladder 12 under a lower bolster 14, preferably formed of steel. The source of pressure may be air or hydraulic. The upper face of an independently movable bolster 16 of an independently movable platen assembly is mounted on shafts 18 of pistons (not shown) of hydraulic cylinders 20, the pistons being capable of being lowered or retracted as required. An insulating layer 22 is fixed to the lower face of bolster 16 to insulate bolster 16 from a heating means 24. A vented heat exchanging means 26 is fixed to the underside of heating means 24. The hydraulic cylinders 20 are mounted on a frame 28 independent of a combination frame 30 of the press 10. When the pistons are lowered, the independently movable platen assembly (formed by bolster 16, insulating layer 22, heating means 24 and vented heat exchanging means 26) is lowered and contacts a membrane 32 to provide a so-called "rigid membrane". This enables flat pressing of a workpiece which is normally positioned on a base board (not shown) in chamber 34 above lower vented heat exchanging means 36. Similarly, the upper face of bottom steel bolster 14 is covered by lower insulating layer 40 insulating bolster 14 from lower heating means 38. The numerals 42 and 44 respectively designate the loading tray and portion of the fixed or moving frame of press 10, while numeral 46 designates the press base bolster.

Figure 2:
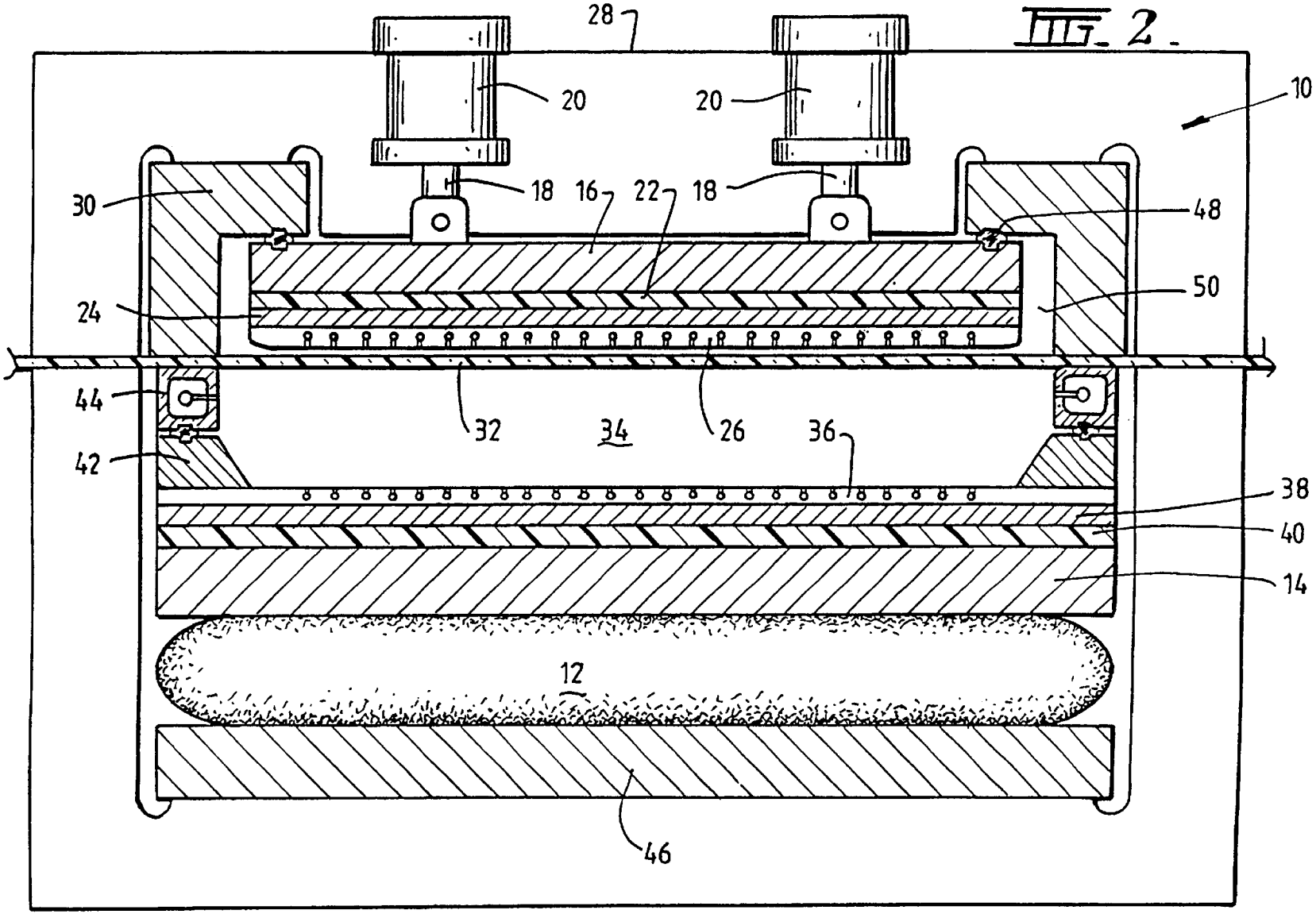
FIG. 2 is the same view showing the press being used as a flexible membrane diaphragm press.

FIG. 2 shows retraction of the platen assembly to provide a standard flexible membrane press. The sealing 48 between the upper face of bolster 16 and the combination frame 30 results in the formation of a pressurizable chamber 50 as in conventional diaphragm presses.

When using the press with a sprayable glue line, also referred to as adhesive, the surface(s) of the workpiece to be processed are sealed by the spray application of a quality glue line taking into account variations in absorption rates, and allowed to flush off as per manufacturer's instructions.

Standard jigging, base board and foil preparation then can be completed. The workpiece can then be recoated with an even coat of glue and allowed to dry or it can be placed on the base board with a wet tacky coat of adhesive, then covered by the foil to be attached. Alternatively, a dry adhesive file can be placed between the foil and the workpiece, or the workpiece can be covered with adhesive-backed foil.

This resultant assembly can be inserted via the tray, table or belt into the pressure chamber which is subsequently closed.

An appropriate cycle for the operation of the press is selected. This cycle includes the steps of causing the independently movable platen to make contact via the membrane with the top surface of the component either once or several times for predetermined periods of time. As a result, the foil becomes firmly attached to the workpiece. During this stage no air pressure is required in the chamber. The independently movable platen assembly is then retracted and locked and sealed to the combination frame and standard press cycles are resumed as required. With the foil firmly attached to all top surfaces of the workpiece the risk of creasing during pre-heat and final forming is significantly reduced.

It is to be understood that variations and modifications can be made to the invention disclosed and the embodiment described and that the embodiment is one embodiment only of the invention, and that changes can be made thereto without departing from the spirit of the invention.

What is claimed is:

1. A multi function diaphragm press including upper and lower platen assemblies separated by a flexible membrane, one of said platen assemblies being movable between a first position whereby said one of said platen assemblies does not contact said flexible membrane and a second position whereby said flexible membrane is in contact with said one of said platen assemblies to provide a rigid membrane, wherein in said first position said one of said platen assemblies cooperates with a frame of said multi-function diaphragm press and said membrane to provide a pressure chamber, whereby said flexible membrane can contact a workpiece inserted between said flexible membrane and the other of said platen assemblies allowing said flexible membrane to follow the contours of said workpiece.

2. The multi-function diaphragm press of claim 1, wherein said one of said platen assemblies is moved by hydraulic means.

3. The multi-function diaphragm press of claim 2, wherein said one of said platen assemblies includes sealing means which cooperates with said frame to ensure fluid tightness of said pressure chamber.

4. The multi-function diaphragm press of claim 2, wherein each of said platen assemblies includes a plate or bolster, a heating means and a vented heat exchanging means.

5. The multi-function diaphragm press of claim 2, wherein the other of said platen assemblies is located on a pressure bag or bladder.

6. The multi-function diaphragm press of claim 2, wherein the other of said platen assemblies is movable.

7. The multi-function diaphragm press of claim 1, wherein said one of said platen assemblies includes sealing means which cooperates with said frame to ensure fluid tightness of said pressure chamber.

8. The multi-function diaphragm press of claim 7, wherein each of said platen assemblies includes a plate or bolster, a heating means and a vented heat exchanging means.

9. The multi-function diaphragm press of claim 7, wherein the other of said platen assemblies is located on a pressure bag or bladder.

10. The multi-function diaphragm press of claim 7, wherein the other of said platen assemblies is movable.

11. The multi-function diaphragm press of claim 1, wherein each of said platen assemblies includes a plate or bolster, a heating means and a vented heat exchanging means.

12. The multi-function diaphragm press of claim 11, wherein the other of said platen assemblies is located on a pressure bag or bladder.

13. The multi-function diaphragm press of claim 11, wherein the other of said platen assemblies is movable.

14. The multi-function diaphragm press of claim 1, wherein the other of said platen assemblies is located on a pressure bag or bladder.

15. The multi-function diaphragm press of claim 1, wherein the other of said platen assemblies is movable.

* * * * *